US007350897B2

(12) United States Patent
Ciliberti et al.

(10) Patent No.: US 7,350,897 B2
(45) Date of Patent: Apr. 1, 2008

(54) FLUSHING SYSTEM AND PROCESS FOR FLUSHING THE SAME

(75) Inventors: Michael N. Ciliberti, East Fallowfield, PA (US); Charles W. Dodson, Jr., Morgantown, PA (US); Richard Hochheim, Chadds Ford, PA (US); Leonardo R. Rota, Havertown, PA (US)

(73) Assignee: E I. du Pont de Nemours and Company, Wilmington, DE (US)

( * ) Notice: Subject to any disclaimer, the term of this patent is extended or adjusted under 35 U.S.C. 154(b) by 389 days.

(21) Appl. No.: 11/119,241

(22) Filed: Apr. 29, 2005

(65) Prior Publication Data

US 2005/0253892 A1 Nov. 17, 2005

Related U.S. Application Data

(60) Provisional application No. 60/571,054, filed on May 14, 2004.

(51) Int. Cl.
*B41J 2/165* (2006.01)

(52) U.S. Cl. ..... 347/28; 347/29; 347/30

(58) Field of Classification Search ..... None
See application file for complete search history.

(56) References Cited

U.S. PATENT DOCUMENTS

| | | | | |
|---|---|---|---|---|
| 6,409,304 | B1 | 6/2002 | Taylor | |
| 6,422,680 | B1 * | 7/2002 | Hayakawa et al. | 347/30 |
| 6,604,810 | B1 | 8/2003 | Silverbrook | |
| 6,641,248 | B2 | 11/2003 | Mitsui et al. | |
| 6,869,160 | B2 * | 3/2005 | West et al. | 347/28 |

* cited by examiner

*Primary Examiner*—Shih-Wen Hsieh

(57) ABSTRACT

The present invention relates to various embodiments for a flushing system for an ink jet printer, wherein a flushing fluid source provides a flushing fluid to a manifold wherein the flushing fluid is introduced into the printer's lines, and capping device as well as past the print heads, wherein residual ink is reduced or removed.

4 Claims, 3 Drawing Sheets

FLUSHING SYSTEM AND PROCESS FOR FLUSHING THE SAME

CROSS-REFERENCE TO RELATED APPLICATIONS

This application claims priority under 35 U.S.C. §119 from U.S. Provisional Application Ser. No. 60/571,054 (filed May 14, 2004), the disclosure of which is incorporated by reference herein for all purposes as if fully set forth.

BACKGROUND OF THE INVENTION

Generally in the inkjet printing industry, printing quality is determined by a number of factors, including establishment of a proper meniscus at the print head nozzle exit, providing clean print heads and ensuring the operability of the printer. To assist in maintaining the printer, the print heads often require priming, which serves to re-establish the proper menisci and provides for proper ink flow through the print head. Priming the print heads generally includes having the capping device brought into intimate contact with the printing head, thereby forming a sealed interior area. Subsequently a negative pressure may be applied to this interior space allowing for the forcible ejection of ink from the print head and priming the print head. However, the priming process is problematic in that, the ink lines are allowed to simply leak out into the general printer environment or into a waste container, however, when the printing system is not used for extended periods of time (e.g. several days to several months or longer) the nature of the inks may cause either partial or full blockages of the lines, thereby negatively impacting the priming function.

Thus, there is a need within the printing industry for a flushing system allowing for proper maintenance of printers. As a result, the embodiments of the present invention reduce the risk of capper device performance degradation over time, thus providing more consistent and robust printing performance.

SUMMARY OF THE INVENTION

The present invention generally relates to embodiments of a flushing system (1) for cleaning an inkjet printer comprising:

(a) a flushing fluid source (2) containing a flushing fluid;

(b) a manifold (3) having an interior portion defined by a floor (4), a ceiling (5), at least one side wall (6), at least one flushing fluid charging port (7) and at least one flushing fluid charging line (8) having a first valve (18), at least one flushing fluid discharge port (9) and at least one flushing fluid discharge line (10) having a second valve (19) in fluid communication with a waste-receiving container (11), and at least one ink port (16) and line (17), wherein the manifold (3) is in fluid communication with the flushing fluid source (2) using the at least one flushing fluid charging line (8);

(c) at least one capping device (12) in fluid communication with the manifold (3) using the at least one ink line (17), wherein the capping device (12) is capable of forming a seal with at least one ink jet print head;

(d) a clamp (13) capable of preventing fluid flow through the at least one ink line (17); and (e) a negative pressure source (14) in fluid communication with the flushing fluid source (2), the manifold (3) and the at least one capping device (12) using an evacuation line (15).

The present invention further relates to embodiments of a process for flushing an ink jet printer comprising the steps of:

(1) applying a negative pressure to the flushing system described above and in further detail below;

(2) opening a first valve;

(3) introducing a flushing fluid to the flushing system; and (4) draining the flushing system;

wherein residual ink is flushed from system components as well as from a print head.

These and other features and advantages of the present invention will be more readily understood by those of ordinary skill in the art from a reading of the following detailed description. It is to be appreciated that certain features of the invention which are, for clarity, described above and below in the context of separate embodiments, may also be provided in combination in a single embodiment. Conversely, various features of the invention that are, for brevity, described in the context of a single embodiment, may also be provided separately or in any subcombination. In addition, references in the singular may also include the plural (for example, "a" and "an" may refer to one, or one or more) unless the context specifically states otherwise. Further, reference to values stated in ranges include each and every value within that range.

DETAILED DESCRIPTION OF THE PREFERRED EMBODIMENTS

Figure 1:
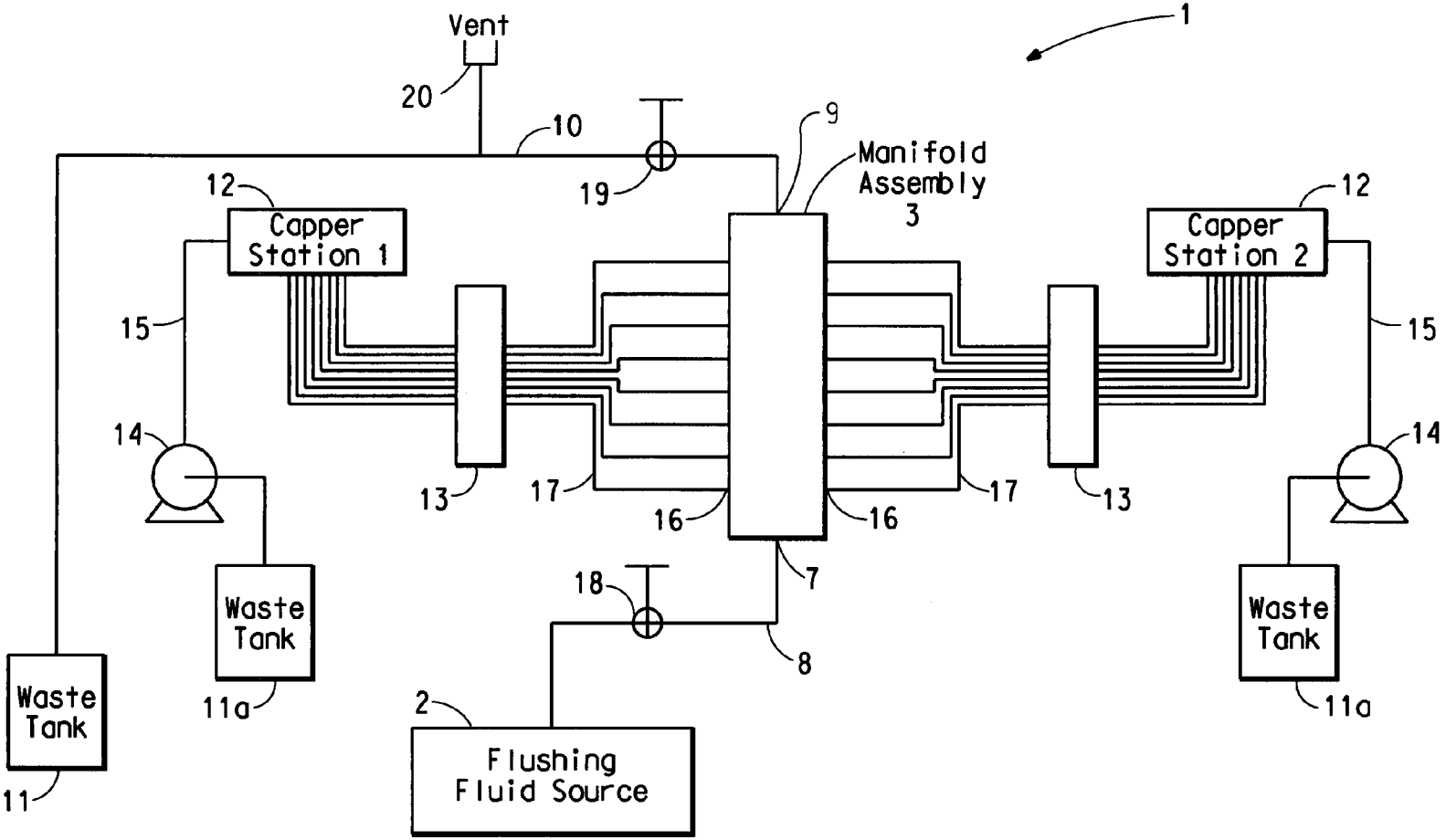
FIG. 1 depicts a schematic of an embodiment of a flushing system.
Figure 2:
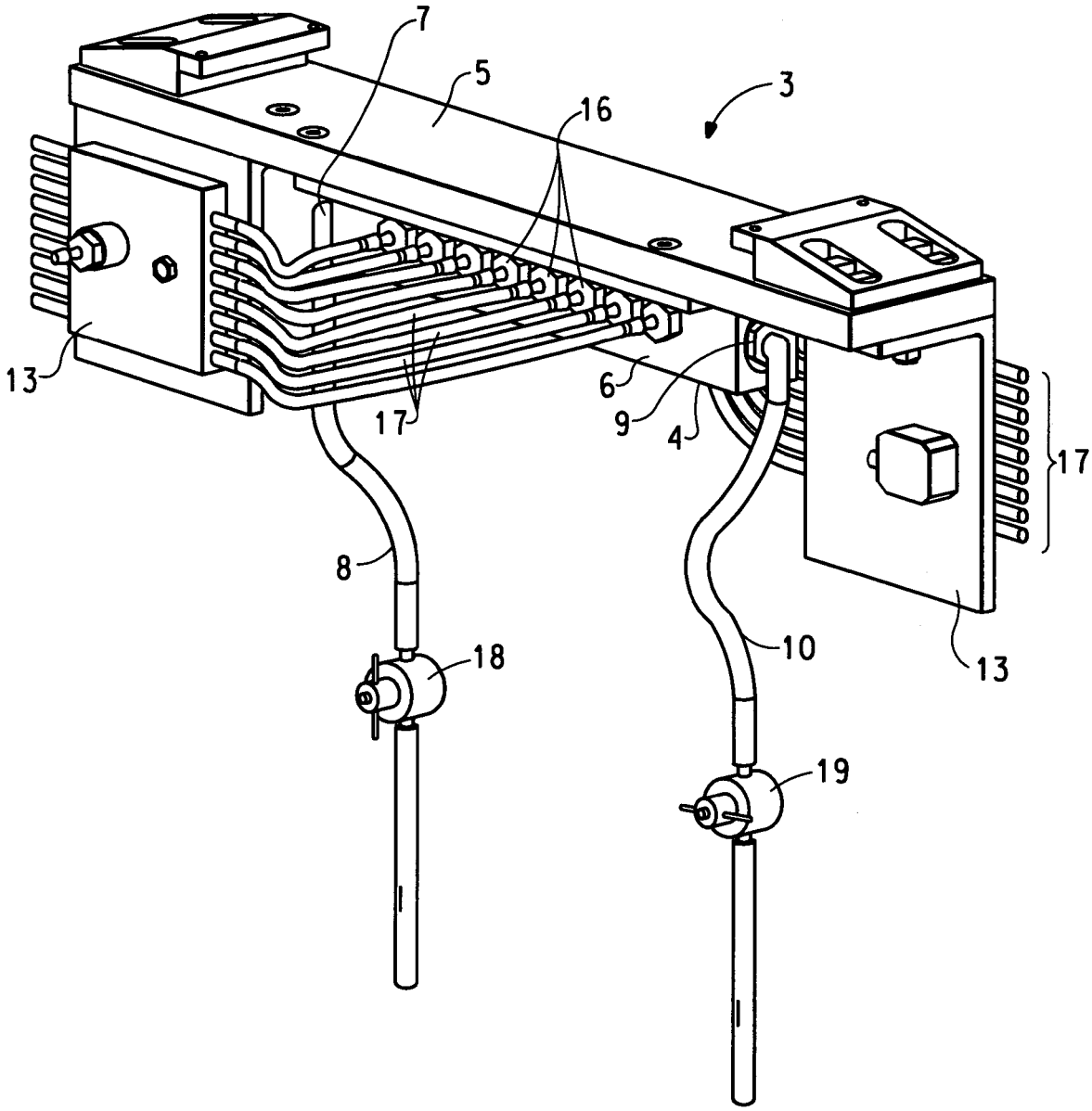
FIG. 2 shows a front view of an embodiment of the manifold lines and valves.
Figure 3:
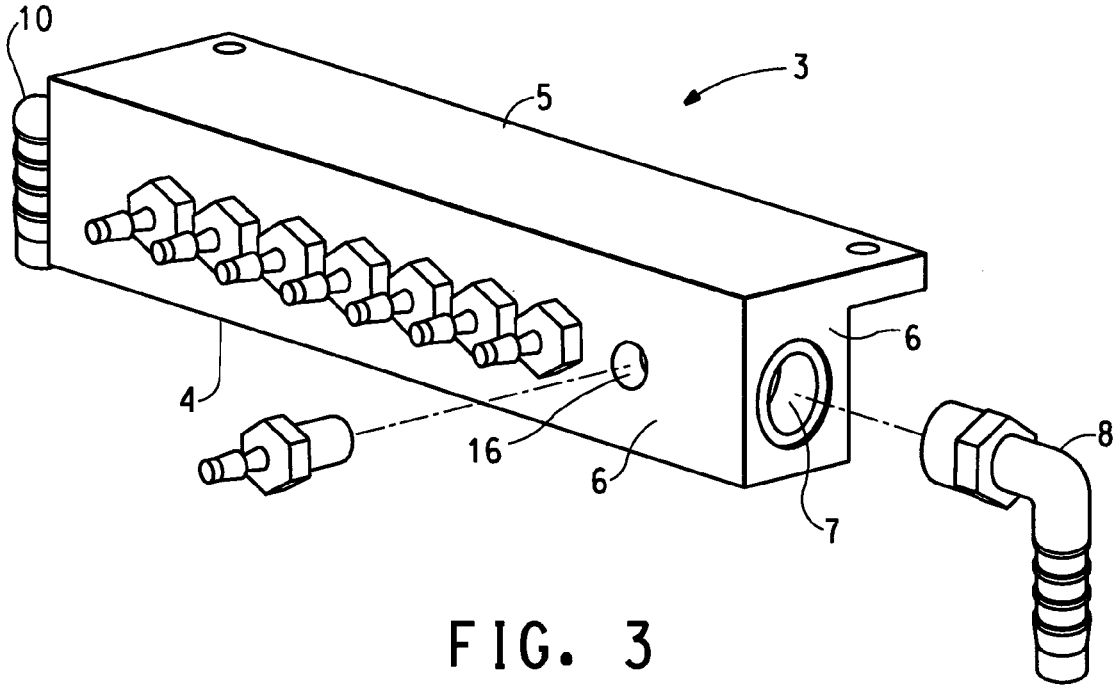
FIG. 3 shows a front view of an embodiment of the manifold having at least one ink port, at least one ink line, at least one flushing fluid charging/discharge port and line.

The embodiments of the present invention provide a flushing system for use with inkjet printers as well as processes including the same, wherein any residual ink is reduced or removed, thereby preventing the ink from affecting printing performance.

Generally the flushing system (1) is governed by the use of a negative pressure source (14) such as, for example, a peristaltic tubing pump, which creates a negative pressure in the system thereby pulling the flushing fluid throughout the system. An example of a suitable pump is model WPX-1-J3.18M available from Welco Co. Ltd, Tokyo, Japan. Typically the flushing fluid source (2) may be either a batch-type source (e.g. a reservoir containing the flushing fluid, wherein the reservoir is refillable), or it may be a continuous source wherein there is no requirement for the reservoir to be changed or refilled. In either case, the fluid source (2) should be capable of providing sufficient amounts of fluid for the flushing process and should be constructed of materials that are non-reactive with the flushing fluid being used.

The flushing fluid may comprise one or a combination of a variety if fluids. Typically, the type of flushing fluid used will be dependent upon the ink, however, flushing fluids that may be used include, but are not limited to, water, solvent(s) and mixtures thereof. Those suitable solvents are well-known to those skilled in the art.

As noted above, the various components of the embodiments of the present invention are in fluid communication by way of the fluid lines. The at least one flushing fluid charging line (8) and port (7) allow the flushing fluid source (2) and the manifold (3) to be in fluid communication, whereas the flushing fluid discharge line (10) and port (9) allow the manifold to be in fluid communication with a waste-receiving container (11). The at least one ink line (17) and port (16) allow for the manifold (3) to be in fluid communication with the capping device (12). The evacuation line (15) allows the negative pressure source (14) to be in fluid communication with the rest of the flushing system.

The fluid communication may be provided by any number of materials; however, such materials should not react with the flushing fluid. Examples of suitable materials for fluidly connecting the various components include, but are not limited to, flexible tubing, preferably medical grade rubber tubing having an inside diameter of about 2 millimeters and an outside diameter of about 4 millimeters. For example, a suitable tubing for use with the embodiments of the present invention include silicone tubing (¼ inch ID, ⅜ inch OD) model No. 51135K281 available from McMaster Carr Supply Company, Atlanta, Ga. Moreover, the fluid connections must be fitted with valves, either manual or automatic, in order to allow the system to return to atmospheric pressure in order to continue the printing process. The valves are located on both the flushing fluid charging line (a first valve (18)) as well as on the flushing fluid discharge line (a second valve (19)). While those skilled in the art recognize those types of valves suitable in this embodiment, an example of a suitable valve includes, but is not limited to, stopcock valves, such as for example, a stopcock valve having part no. 48285K24 available from McMaster Carr Supply Company, Atlanta, Ga.

Generally, at least one clamp (13) such as, for example, an actuating clamp is used on the fluid communication lines running between the manifold (3) and the capping device (12). Suitable clamps (13) are known to those known in the art, where the clamps (13) are capable of compressing the flexible tubing (17) to prevent fluid flow.

The manifold (3) has an interior portion defined by a floor (4), a ceiling (5), at least one side wall (6) (in the case of a cylindrical manifold) but preferably at least two side walls (6), at least one flushing fluid charging port (7), at least one flushing fluid discharge port (9), and at least one ink port (16), wherein the manifold (3) is in fluid communication with the flushing fluid source (2), the capping device (12) and the waste-receiving containers (11,11*a*).

The manifold (3) preferably has only a single flushing fluid charging port (7) and a single flushing fluid discharging port (9). The ports (7,9) may be located at any position on the manifold (3), preferably the ports are in opposing positions; however, one caveat exists. The location of the ports (7,9) is determined by the interior of the manifold (3), in that, the floor (4) of the manifold is sloped towards the at least one flushing fluid discharge port (9) and line (10) in order to assist in the drainage of flushing fluid. Therefore, most preferably, the at least one flushing fluid charging port (7) is located where the distance from the floor (4) to the ceiling (5) of the manifold (3) is at its minimum, whereas the at least one flushing fluid discharge port (9) is positioned where the distance from the floor (4) to the ceiling (5) is at its maximum. The at least one ink port (16) and at least one ink line (17) allow for the ink to flow from the capping device (12) and into the manifold (3) for disposal in waste tank (11*a*), as well as for the flow of flushing fluid from the manifold (3) towards the capping device (12) for disposal in waste tank (11*a*). The at least one ink port (16) may be positioned anywhere on the manifold (3).

The manifold (3) is typically constructed of materials capable of withstanding the forces generated during operation, wherein the preferred material is stainless steel. The manifold (3) is not limited to any particular dimension or size as it is not critical; however, preferably, the manifold (3) is small enough to be mounted in the printer itself (not depicted). In terms of its mounting, the manifold (3) is generally not limited as to where it may be positioned on the printer; however, one requirement is necessary. Since the drainage works by utilizing gravity, it is important to locate the manifold (3) in a position that is below the capping system (12) and above the waste-receiving containers (11, 11*a*). Similarly the manifold (3) must be positioned so that the at least one flushing fluid discharge port (9) and line (10) are below any flushing fluid entry ports (7) to utilize gravity to fully drain the manifold (3).

The capping device (12) for use in the embodiments of the present invention include those that are known in the art of ink jet printing, wherein when the print head (not depicted) requires priming, the capping device is brought into intimate contact with the print head, thereby forming a sealed interior area. Subsequently a negative pressure may be applied to this interior space by, for example, the negative pressure source (14) as described above, thereby allowing for the forcible ejection of ink from the print head and priming the print head.

The capping device (12) is in fluid communication with the remainder flushing system (1), and as has the ability to form a seal around the print head, which allows for the application of a vacuum to the print head for priming as well as a vent (20) so that the seal between the print head(s) and capping device can be released and thereby disengage the capper device (12). Ink used in the ink jet printer flows through or at least comes into contact with the internal portions of the flushing system (1), wherein residual ink often remains within the system. This residual ink can dry over time, thereby negatively impacting the priming function and vent operation, which is what the flushing system (1) is designed to minimize.

The embodiments of the present invention allow for these lines to be flushed quickly and efficiently, thus allowing for extended shut-down periods without a drop in printing performance due to ink problems.

Another embodiment of the present invention relates to a process for flushing an inkjet printer comprising the steps of:

(1) applying a negative pressure to the flushing system;

(2) opening a first valve;

(3) introducing a flushing fluid to the flushing system; and (4) draining the flushing system;

wherein the residual ink is flushed from the system components as well as from the print head.

The invention claimed is:

1. A flushing system for cleaning an inkjet printer comprising:

(a) a flushing fluid source containing a flushing fluid;

(b) a manifold having an interior portion defined by a floor, a ceiling, at least, one side wall, at least one flushing fluid charging port and at least one flushing fluid charging line having a first valve, at least one flushing fluid discharge port and at least one flushing fluid discharge line having a second valve in fluid communication with a waste-receiving container, and at least one ink port and line, wherein the manifold is in fluid communication with the flushing fluid source using the at least one flushing fluid charging line;

(c) at least one capping device in fluid communication with the manifold using the at least one ink line, wherein the capping device is capable of forming a seal with at least one ink jet print head;

(d) a clamp capable of preventing fluid flow through the at least one ink line; and (e) negative pressure source in fluid communication with the flushing fluid source, the manifold and the at least one capping device, using an evacuation line, wherein the floor of the manifold is sloped towards the at least one flushing fluid discharge port and at least one flushing fluid discharge line.

2. The flushing system according to claim 1, wherein the flushing fluid comprises water, a solvent and mixtures thereof.

3. The flushing system according to claim 2, wherein the flushing fluid comprises water.

4. A process for flushing an ink jet printer comprising the steps of:

(1) applying a negative pressure to the flushing system according to claim 1;

(2) opening a first valve;

(3) introducing a flushing fluid to the flushing system; and (4) draining the flushing system;

wherein residual ink is flushed from system components as well as from a print head.

* * * * *